US011071342B2

(12) United States Patent
Rola

(10) Patent No.: US 11,071,342 B2
(45) Date of Patent: Jul. 27, 2021

(54) LOW PROFILE SOCK DEVICE

(71) Applicant: Martin D. Rola, Daniel Island, SC (US)

(72) Inventor: Martin D. Rola, Daniel Island, SC (US)

( * ) Notice: Subject to any disclaimer, the term of this patent is extended or adjusted under 35 U.S.C. 154(b) by 0 days.

(21) Appl. No.: 16/417,153

(22) Filed: May 20, 2019

(65) Prior Publication Data

US 2019/0350286 A1 Nov. 21, 2019

Related U.S. Application Data

(60) Provisional application No. 62/674,023, filed on May 21, 2018.

(51) Int. Cl.
*A41F 13/00* (2006.01)
*A41B 11/02* (2006.01)

(52) U.S. Cl.
CPC ..... *A41F 13/00* (2013.01); *A41B 11/02* (2013.01)

(58) Field of Classification Search
CPC ..... A41F 13/00; A41B 11/02; A41B 11/125
USPC ..... 2/240
See application file for complete search history.

(56) References Cited

U.S. PATENT DOCUMENTS 872,517 A * 12/1907 Irwin ..... A41B 11/12 2/240
1,093,032 A * 4/1914 Cadenas ..... A43B 3/101 36/9 R
1,278,220 A * 9/1918 Roedelheim ..... A41B 11/12 2/240
1,754,054 A * 4/1930 Selva ..... A43B 5/12 36/8.3
1,788,852 A * 1/1931 Arthur ..... A61F 13/064 602/66
1,930,188 A * 10/1933 Arthur ..... A61F 13/064 602/66
2,237,652 A * 4/1941 Capezio ..... A43B 5/12 36/8.3
D149,683 S * 5/1948 Sandler ..... D2/930
2,805,424 A * 9/1957 Johnson, Jr. ..... A41B 11/12 2/240
3,887,946 A * 6/1975 Laskin ..... A43B 19/00 2/239
3,967,347 A * 7/1976 Bickis, Sr. ..... A44B 11/02 24/200
4,277,897 A * 7/1981 O'Connell ..... A43B 5/12 36/106

(Continued)

*Primary Examiner* — Anne M Kozak
(74) *Attorney, Agent, or Firm* — Patentfile, LLC; Bradley C. Fach; Steven R. Kick

(57) ABSTRACT

A low profile sock device may include a body for receiving portions of a foot of a user. A first retainer may be configured to tension portions of the body, such as a first side and/or a heel region towards a portion of an upper foot region that the first retainer may be coupled to. A second retainer may be configured to tension portions of the body, such as a second side and/or a heel region towards a portion of the upper foot region that the second retainer may be coupled to. The retainers may be used to tension the body to the foot of a user to increase friction between the body and the foot prevent walking/running motion from pushing the body downward at the back of the foot while allowing the body to remain hidden while being worn with a shoe.

9 Claims, 9 Drawing Sheets

(56) References Cited

U.S. PATENT DOCUMENTS 4,457,051 A * 7/1984 Bartolini ..... B29C 66/7392 24/198
5,257,969 A * 11/1993 Mance ..... A61F 5/0113 36/8.3
5,445,598 A * 8/1995 Nguyen-Senderowicz ..... A41F 13/00 602/28
D381,465 S * 7/1997 Estell ..... D2/917
6,367,087 B1 * 4/2002 Spillman ..... A41B 11/004 2/239
D517,784 S * 3/2006 Wilkenfeld ..... D2/902
D530,888 S * 10/2006 Kim ..... D2/896
D538,515 S * 3/2007 Wilkenfeld ..... D2/902
D551,430 S * 9/2007 Wilkenfeld ..... D2/902
D634,103 S * 3/2011 Nataadiningrat ..... D2/896
7,966,747 B2 * 6/2011 Wilkenfeld ..... A43B 3/06 36/8.3
8,127,466 B1 * 3/2012 Raval ..... A43B 7/22 36/8.3
D683,112 S * 5/2013 James ..... D2/896
D821,068 S * 6/2018 Coleman ..... D2/896
D873,552 S * 1/2020 Lin ..... D2/980
10,561,201 B1 * 2/2020 Woodbury ..... A43B 1/0081
2003/0070319 A1 * 4/2003 Minden ..... A43B 3/108 36/8.3
2008/0034613 A1 * 2/2008 Wilkenfeld ..... A43B 13/16 36/8.3
2009/0013450 A1 * 1/2009 Lambertz ..... A61F 13/066 2/239
2009/0100715 A1 * 4/2009 Broadley ..... A43B 5/12 36/102
2009/0192428 A1 * 7/2009 DeBoer ..... A61F 13/065 602/27
2011/0252541 A1 * 10/2011 Hoeven ..... A41B 11/10 2/239
2014/0207042 A1 * 7/2014 Amanatullah ..... A61F 5/042 602/28
2014/0259774 A1 * 9/2014 Minden ..... A43B 23/027 36/97
2015/0007457 A1 * 1/2015 Orza ..... A43B 7/1425 36/102
2015/0096107 A1 * 4/2015 Krumel ..... A41B 11/008 2/239

* cited by examiner

LOW PROFILE SOCK DEVICE

CROSS REFERENCE TO RELATED APPLICATIONS

This application claims priority to and the benefit of the filing date of U.S. Provisional Application No. 62/674,023, filed on May 21, 2018, entitled "LOW PROFILE SOCK WITH IMPROVED HEEL RETENTION", which is hereby incorporated by reference in its entirety.

FIELD OF THE INVENTION

This patent specification relates to the field of foot covering devices. More specifically, this patent specification relates to a sock device that is configured to cover portions of the foot of a user and to withstand frictional forces of a shoe to remain in place on the foot.

BACKGROUND

Low profile, or "no show" socks are used when people desire to wear socks but do not want them to be visible when worn with shoes. A common problem with this style of sock is that it tends to slip off the heel of the foot while being worn. This occurs primarily because to remain hidden, the sock is completely below the top of the back of the shoe, and the friction that occurs while walking between the sock and the shoe is greater than the friction between the foot and the sock, so the walking motion pushes the sock downward on the foot, creating discomfort. A common approach to solving this problem is to add some form of "non-slip" material to the inside of the sock at the back above the heel to increase the level of friction between the sock and the foot. Some socks also include an elastic member secured at two points primarily along the side of the sock to apply tension between the rear and front of the sock, and some may also include an elastic ring around the top of the sock where the sock meets the top of the foot. While these all provide some improvement to the ability of the sock to remain in place, they do not address the problem in all cases, and the sock slips down or off the back of the foot while being worn with shoes. These approaches also do not allow the wearer to adjust the level of tension, which helps to accommodate various foot sizes and shapes with one size or limited sizes of socks or under different conditions such as desiring higher tension while running, jumping, or performing other vigorous activities.

Therefore, a need exists for a novel sock device that is configured to cover portions of the foot of a user and to withstand frictional forces of a shoe to remain in place on the foot. A further need exists for a novel sock device that is able to accommodate a wide range of foot sizes. Yet a further need exists for a novel sock device that is able to be adjusted and which is able to overcome a drawback common to existing socks in which existing socks are non-adjustable and stretch or lose elasticity over time.

BRIEF SUMMARY OF THE INVENTION

A low profile sock device is provided. The device may be configured to function as a sock which may be secured in place while being worn to be used with or without the non-slip materials and other means of securing the sock described above. The device may include one or more retainers which may function as a mechanical means to increase the amount of tension and resulting stiction and friction between the device and the foot to prevent the walking or running motion from pushing the device downward at the back of the foot while allowing the device to remain hidden while being worn with a shoe. The device also provides methods for the amount of tension applied by the retainers to be adjusted to a desired level. The device may be adjustable to enable one size of device to accommodate a wider size range of feet while retaining the required amount of force to keep the device in place of the foot.

In some embodiments, the device may include a body for receiving portions of a foot of a user. The body may have a heel region, a toe region, an exterior surface, a first side, a second side, and an upper foot region. A first retainer may be coupled to the upper foot region and to the heel region, and the first retainer may be configured to tension the upper foot region and the heel region towards each other. A second retainer may be coupled to the upper foot region and to the heel region, and the second retainer may also be configured to tension the upper foot region and the heel region towards each other.

In further embodiments, the device may include a body for receiving portions of a foot of a user. The body may have a heel region, a toe region, an exterior surface, a first side, a second side, and an upper foot region. A unitary retainer may be coupled to the upper foot region. A first retainer may be coupled to the unitary retainer and to the first side, and the first retainer may be configured to tension the unitary retainer and the first side toward each other. A second retainer may be coupled to the unitary retainer and to the second side, and the second retainer may be configured to tension the unitary retainer and the second side towards each other.

In still further embodiments, the device may include a body for receiving portions of a foot of a user. The body may have a heel region, a toe region, an exterior surface, a first side, a second side, and an upper foot region. A first retainer may be coupled to the upper foot region and to the heel region, and the first retainer may be configured to tension the upper foot region and the heel region towards each other. A second retainer may also be coupled to the upper foot region and to the heel region, and the second retainer may be configured to tension the upper foot region and the heel region towards each other. A first aperture may be coupled to the first side, and portions of the first retainer may be movably received in the first aperture. A second aperture may be coupled to the second side, and portions of the second retainer may be movably received in second first aperture.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

Figure 1A:
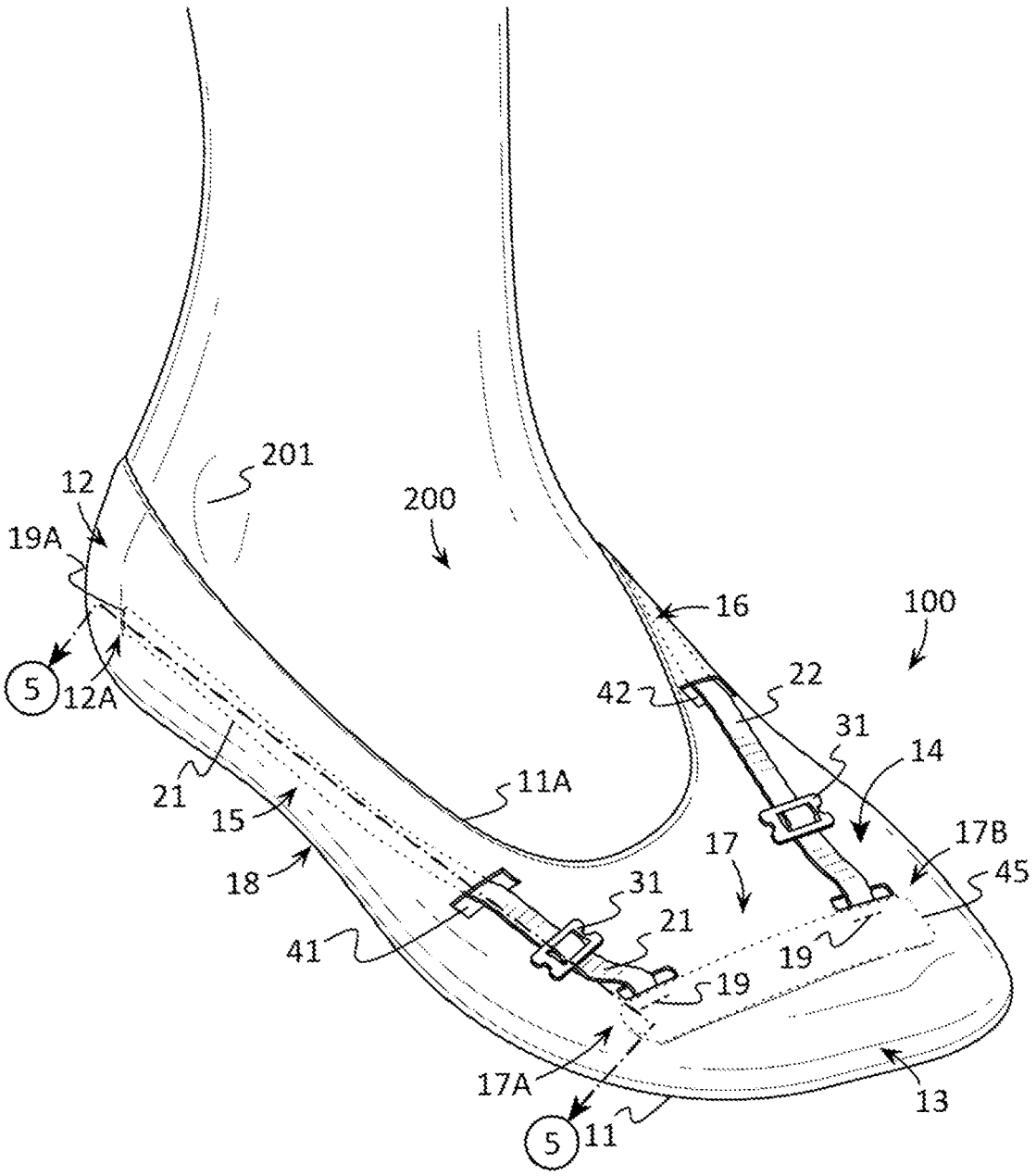
FIG. 1A-FIG. 1A depicts a first side perspective view of an example of a low profile sock device according to various embodiments described herein.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new foot covering device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1A-4B illustrate examples of a low profile sock device ("the device") 100 according to various embodiments. In some embodiments, the device 100 may comprise a body 11 for receiving portions of a foot 200 of a user. The body 11 may have a heel region 12, a toe region 13, an exterior surface 14, a first side 15, a second side 16, an upper foot region 17, and an interior surface 20. A first retainer 21 may be configured to tension portions of the body 11, such as the first side 15 and/or heel region 12 towards a portion of the upper foot region 17 that the first retainer 21 may be coupled to. A second retainer 22 may be configured to tension portions of the body 11, such as the second side 15 and/or heel region 12 towards a portion of the upper foot region 17 that the second retainer 22 may be coupled to. The retainers 21, 22, may be used to tension the body 11 to the foot 200 of a user to increase friction between the body 11 and the foot 200 prevent walking/running motion from pushing the body 11 downward at the back of the foot 200 while allowing the body 11 to remain hidden while being worn with a shoe. The body 11 may be configured as being low profile such that the body 11 does not extend to or above the ankle 201 of the foot 200.

In preferred embodiments, the device 100 may comprise a body 11 which may be configured generally in the shape of a sock so that portions of the foot 200 of a user may be covered or received by the body 11. The body 11 may comprise a body perimeter 11A which may form and bound the opening that portions of the foot 200 may enter and exit the body 11. A heel region 12 may comprise a portion of the body 11 which may cover or contact portions of the heel. A toe region 13 may comprise a portion of the body 11 which may cover or contact portions of the toes. Generally, a toe region 13 and a heel region 12 may be positioned on opposing sides of the body 11. A first side 15 may comprise a portion of the body 11 which may cover or contact portions of the right side or left side of the foot 200 depending on which foot 200 the device is positioned. A second side 16 may comprise a portion of the body 11 which may cover or contact portions of the right side or left side of the foot 200 depending on which foot 200 the device is positioned. Generally, a first side 15 and a second side 16 may be positioned on opposing sides of the body 11 and extend between the toe region 13 and heel region 12. The body 11 may also comprise a sole region 18 which may cover or contact portions of the sole of the foot 200, and the sole region 18 may be coupled to the heel region 12, toe region 13, first side 15, and second side 16. An upper foot region 17 may cover or contact portions of the foot 200 opposite to the sole of the foot 200 (and sole region 18), preferably extending from the proximal interphalangeal joints to the metatarsophalangeal joints, and optionally from the proximal interphalangeal joints to the intermetatarsal joints, on the foot of the user 200. An exterior surface 14 may form the exterior surfaces of the body 11 which may be used to contact a shoe or other article of footwear and which may extend across the heel region 12, toe region 13, first side 15, second side 16, and sole region 18, while an interior surface 20 may form the portions of the body 11 which may contact portions of the foot 200 of the user.

The components of the body 11, such as the heel region 12, toe region 13, exterior surface 14, first side 15, second side 16, and sole region 18 may be fabricated from materials suitable for hosiery and garment applications, including fabrics of natural and synthetic materials such as, for example, nylon, satin, spandex, cotton, silk, and polyester or blends thereof, woven materials such as felt, non-woven materials including non-woven spunbond or carded webs of polypropylene, polyethylene, nylon, polyester, a non-woven web of cellulosic fibers, textile fibers such as rayon fibers, or a blend of cellulosic and textile fibers; or melt blown thermoplastic fibers, such as macro fibers or micro fibers of polypropylene, polyethylene, polyester or other thermoplastic materials or mixtures of such thermoplastic macro fibers or micro fibers with cellulosic, pulp or textile fibers, and natural fibers (e.g., wood or cellulose), may be used depending on the particular application. Preferably, the body 11 may be elastic or resilient. One skilled in the art, however, will realize that other materials suitable for manufacture, in accordance with the present disclosure would be appropriate. The components of the body 11 may be configured in any shape and size to form a body 11 that may be suitable for receiving any human foot size.

The device 100 may comprise one or more retainers, such as a first retainer 21 and a second retainer 22, which may be used to tension one or more portions of the body 11 to the foot 200 of a user to increase friction between the body 11 and the foot 200. A retainer 21, 22, may be configured in any shape and size. Preferably, one or more of the retainers 21, 22, may be configured generally as a strap having a length and width that are significantly greater than the thickness of the retainer 21, 22. In further embodiments, a retainer 21, 22, may be configured with a cord, rope, string, yarn, or any other shape.

A retainer 21, 22, may be made from or may comprise any flexible material, such as which may be used to form portions of the body 11. In some embodiments, a retainer 21, 22, may be configured to tension two or more components 12, 13, 14, 15, 16, 17, 18, towards each other by having the retainer 21, 22, being made from a flexible material that is slightly shorter than the desired distance between the two or more components 12, 13, 14, 15, 16, 17, 18, so that the retainer 21, 22, may stretch the two or more components 12, 13, 14, 15, 16, 17, 18, towards each other. For example, a retainer 21, 22, may be made from or may comprise synthetic webbing, such as nylon webbing, polypropylene webbing, polyester webbing, woven material, fabric or cloth material, natural webbing, such as cotton webbing, other non-fabric flexible materials such as silicone, rubber, plastics, or any other suitable flexible material.

In some embodiments, a retainer 21, 22, may be configured to tension two or more components 12, 13, 14, 15, 16, 17, 18, towards each other by having the retainer 21, 22, being made from a resilient material that is slightly shorter than the desired distance between the two or more components 12, 13, 14, 15, 16, 17, 18, so that the retainer 21, 22, may stretch and tension the two or more components 12, 13, 14, 15, 16, 17, 18, towards each other. In preferred embodiments, a retainer 21, 22, may be made from or may comprise a resilient material which may generally be a flexible material that is elastic and able to resume its shape after deformation. For example, a resilient material may comprise or may be formed from spandex, lastex, rubber, silicone rubber, elastic plastics, braided elastic material, a woven elastic material, or a knitted elastic material, braided elastic fabric materials, woven elastic fabric materials, knitted elastic fabric materials, neoprene, elastane, cotton swimwear elastic, roll elastic, non-roll elastic, elastic silicone, elastic rubbers, or any other suitable elastic, elastomer, or any other resilient material which may be stretched to become elongated and which may return to its original length when not being stretched.

Turning now to FIGS. 1A-2B, two example devices 100 are illustrated. In some embodiments, the device 100 may comprise a body 11 for receiving portions of a foot 200 of a user. The body 11 may have a heel region 12, a toe region 13, an exterior surface 14, a first side 15, a second side 16, and an upper foot region 17. A first retainer 21 may be coupled to the upper foot region 17 and to the heel region 12, and the first retainer 21 may be configured to tension the upper foot region 17 and the heel region 12 towards each other. A second retainer 22 may be coupled to the upper foot region 17 and to the heel region 12, and the second retainer 22 may also be configured to tension the upper foot region 17 and the heel region 12 towards each other.

Figure 1B:
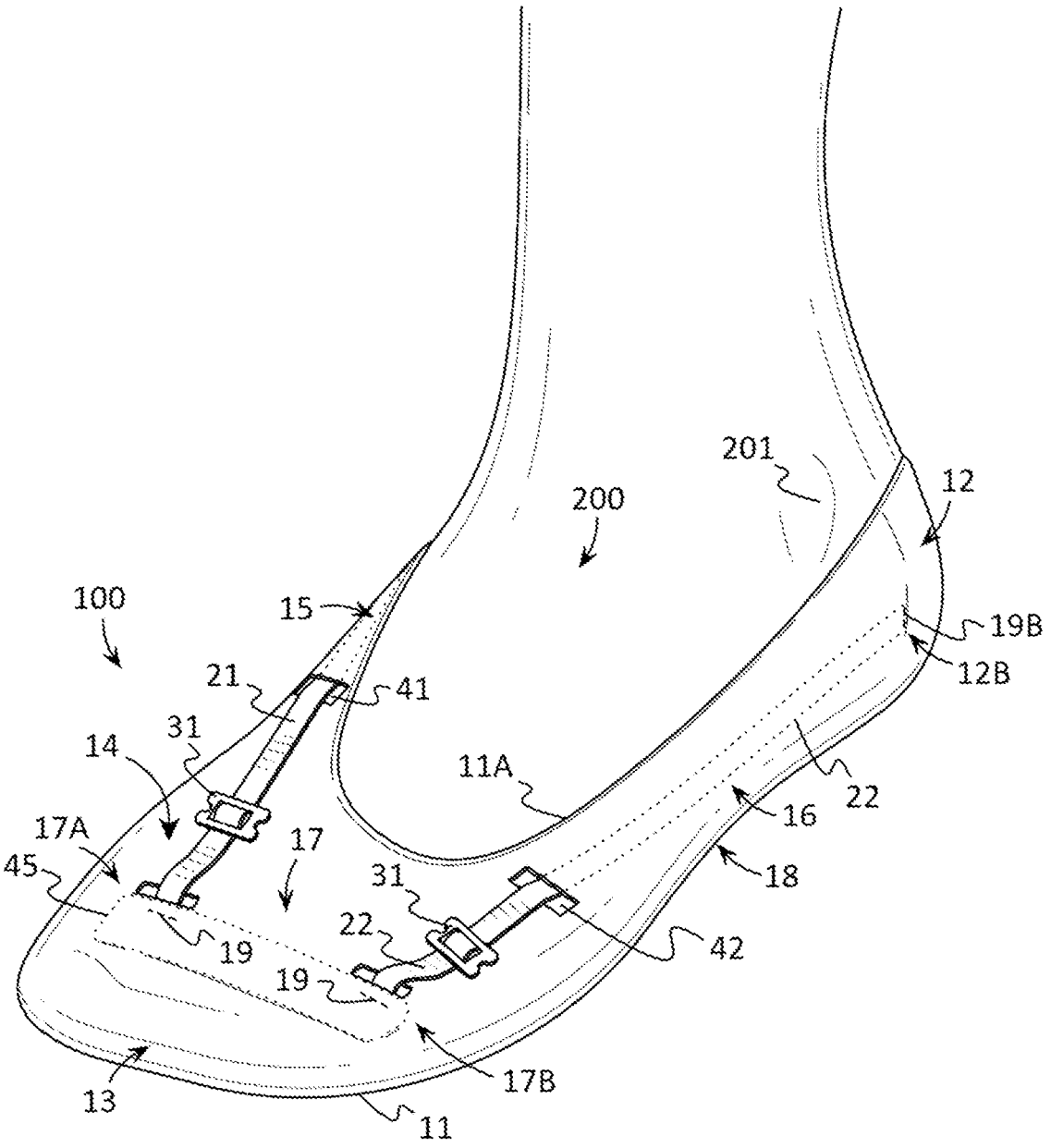
FIG. 1B-FIG. 1B shows a second side perspective view of an example of a low profile sock device according to various embodiments described herein.

In some embodiments and as shown in FIGS. 1A and 1B, the device 100 may comprise a first retainer 21 which may be coupled to a first side of the heel region 12A (portion of the body 11 where the heel region 12 and first side 15 are joined together) and to a first side of the upper foot region 17A (portion of the body 11 where the upper foot region 17 and first side 15 are joined together). The device 100 may also comprise a second retainer 22 which may be coupled to a second side of the heel region 12B (portion of the body 11 where the heel region 12 and second side 16 are joined together) and to a second side of the upper foot region 17B (portion of the body 11 where the upper foot region 17 and second side 16 are joined together).

Figure 2A:
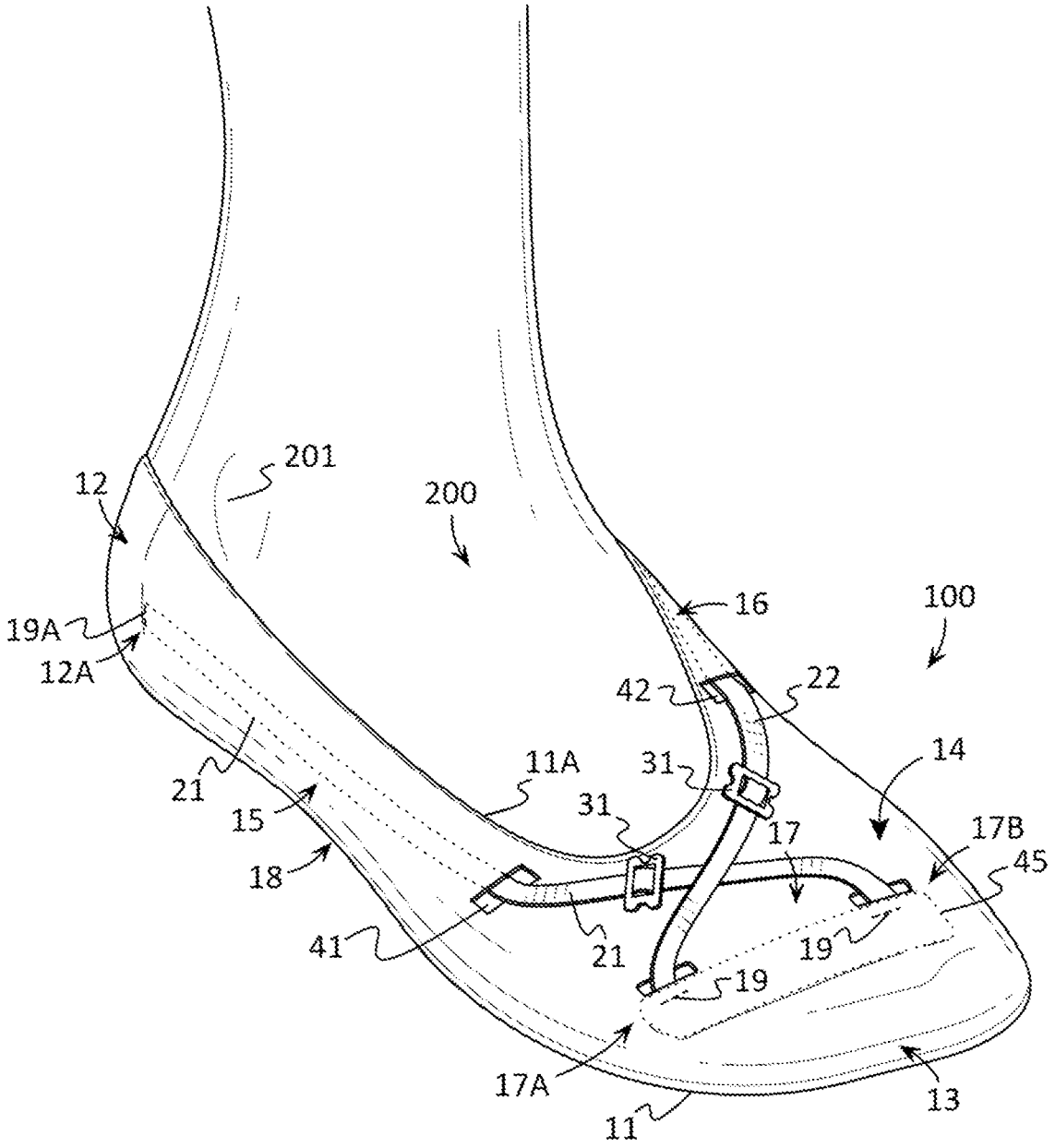
FIG. 2A-FIG. 2A illustrates a first side perspective view of another example of a low profile sock device according to various embodiments described herein.
Figure 2B:
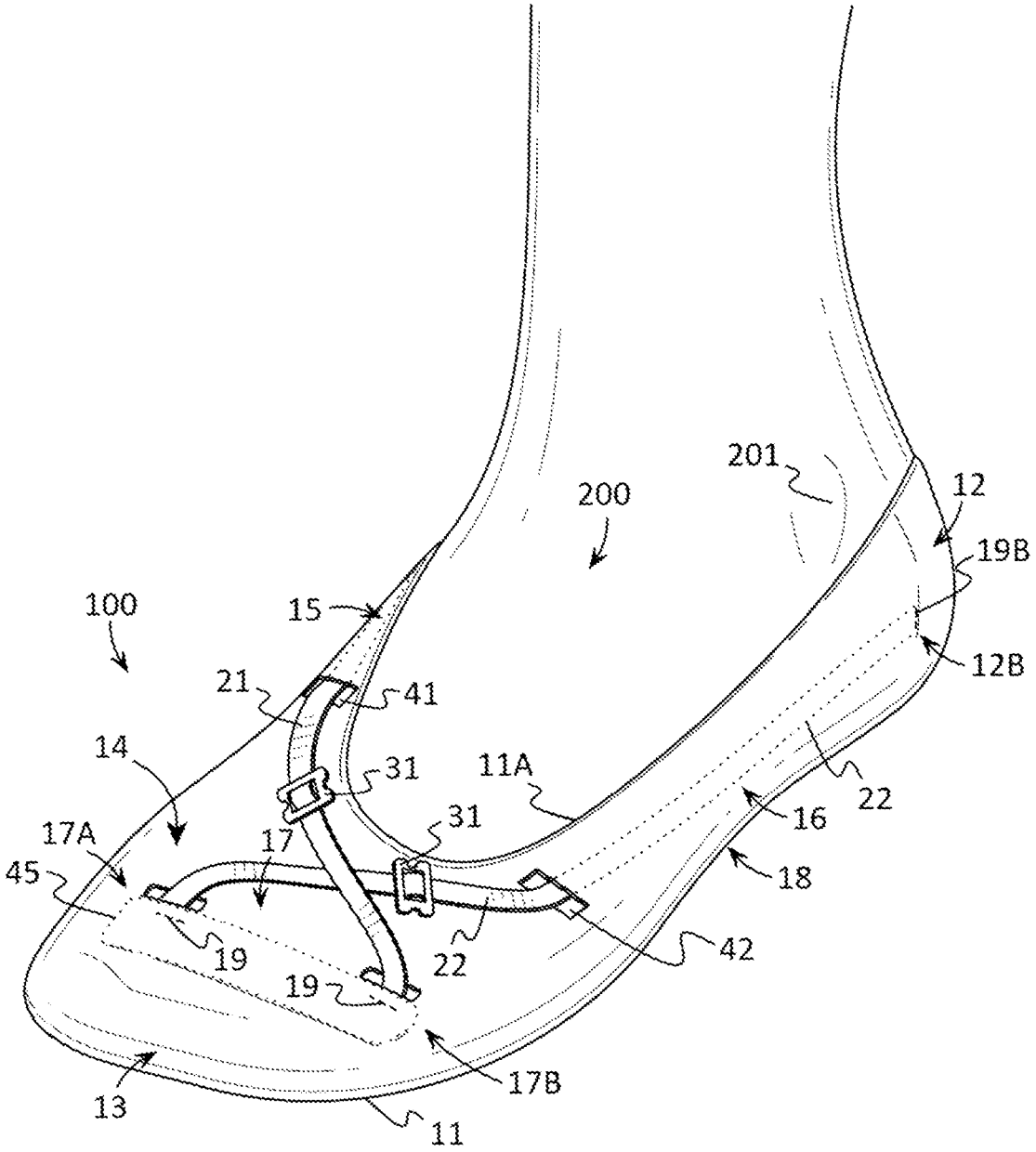
FIG. 2B-FIG. 2B depicts a second side perspective view of another example of a low profile sock device according to various embodiments described herein.

In some embodiments and as shown in FIGS. 2A and 2B, the device 100 may comprise a first retainer 21 which may be coupled to a first side of the heel region 12A (such as with stitching 19A coupling first retainer 21 to first side of the heel region 12A) and to a second side of the upper foot region 17B. The device 100 may also comprise a second retainer 22 which may be coupled to a second side of the heel region 12B (such as with stitching 19B coupling second retainer 23 to second side of the heel region 12B) and to a first side of the upper foot region 17A.

In some embodiments, the device 100 may comprise one or more tensioners 31. Generally, a tensioner 31 may be coupled to a retainer 21, 22, and be configured to adjust the tension that the retainer 21, 22, exerts on two or more components 12, 13, 14, 15, 16, 17, 18, of the body 11, such as by adjusting the length of the retainer 21, 22. In further embodiments, a tensioner 31 may comprise a side release buckle, buckle, clasp, slide, loop, reducer, cam buckle, strap adjuster, snap hook, D ring, tri-loop, footman loop, keeper, cord lock, strap lock, or any other suitable means for adjusting the length of a retainer 21, 22. In still further embodiments, a tensioner 31 may comprise a hook-and-loop fastener, a snap fastener, a clip fastener, a button and/or button hole, or any other type of fastener which may be used to removably couple different portions of a retainer 21, 22, to other portions of the retainer 21, 22, and/or to any other element of the device 100.

In preferred embodiments, the device 100 may comprise one or more apertures, such as a first aperture 41 and a second aperture 42. Generally, a first side 15 may comprise a first aperture 41 and a second side 16 may comprise a second aperture 42. Portions of a first retainer 21 may be movably received in the first aperture 15, while portions of a second retainer 22 may be movably received in second first aperture 42.

In some embodiments and as shown in FIGS. 1A-2B, a first aperture 41 of a first side 15 may be formed in the body 11 by being formed in the first side 15, and a second aperture 42 of a second side 16 may be formed in the body 11 by being formed in the second side 16. In further embodiments, portions of the first retainer 21 that are between the first aperture 41 and the heel region 12 may be positioned below the exterior surface 14 (as shown with the broken lines), and portions of the first retainer 21 that are between the first aperture 41 and the upper foot region 17 may be positioned above the exterior surface 14. Likewise, portions of the second retainer 22 that are between the second aperture 42 and the heel region 12 may be positioned below the exterior surface 14 (as shown with the broken lines), and portions of the second retainer 22 that are between the second aperture 42 and the upper foot region 17 may be positioned above the exterior surface 14. In this manner, an aperture 41, 42, may allow portions of a retainer 21, 22, to pass through the body 11.

In some embodiments, the upper foot region 17 may comprise an upper reinforcement 45, and the first retainer 21 and second retainer 22 may each be coupled to the upper reinforcement 45. An upper reinforcement 45 may be coupled to a portion of the body 11, such as to the upper foot region 17. By coupling a retainer 21, 22, to an upper reinforcement 45 that is coupled to the upper foot region 17, the retainer 21, 22, may be coupled to the upper foot region 17 via the upper reinforcement 45. Preferably, an upper reinforcement 45 may comprise a flexible, and more preferably a resilient material, such as which may be used in the construction of a retainer 21, 22. An upper reinforcement 45 may be coupled to a portion of the body 11 via stitching 19 or any other suitable coupling method.

Figure 4A:
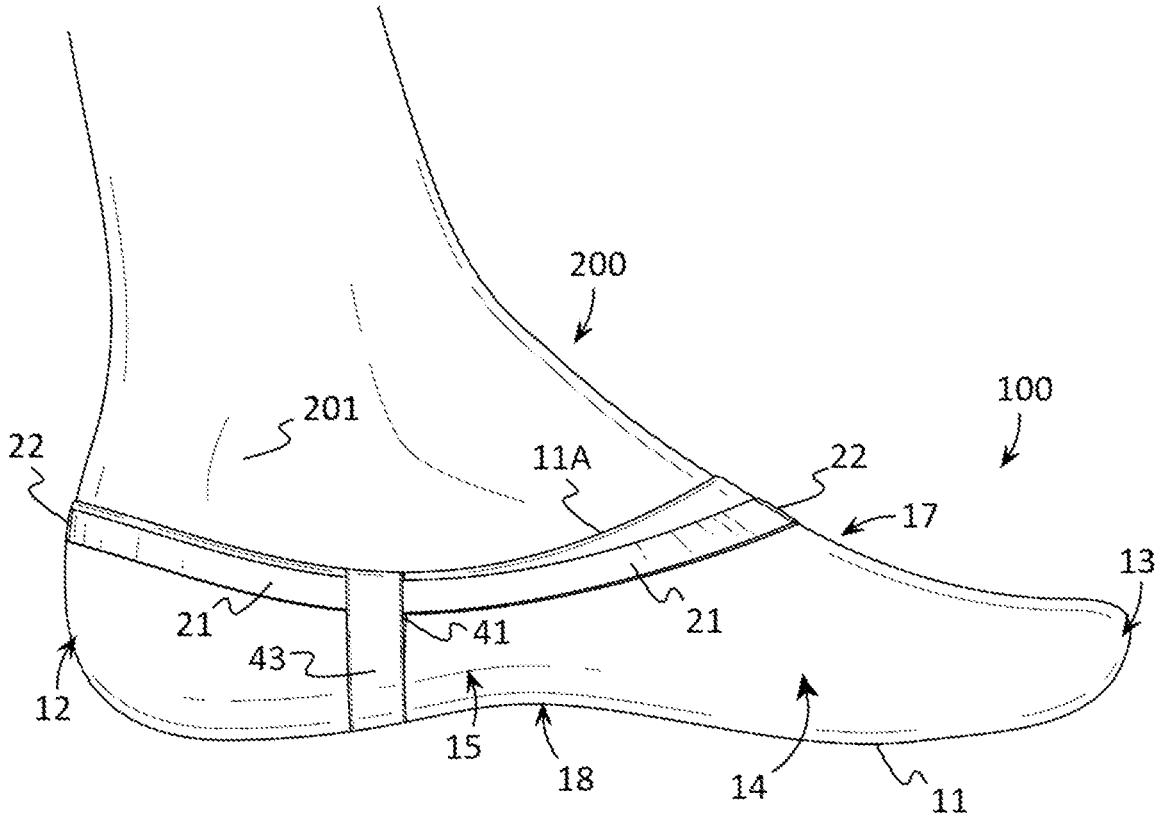
FIG. 4A-FIG. 4A depicts a first side perspective view of yet another example of a low profile sock device according to various embodiments described herein.
Figure 4B:
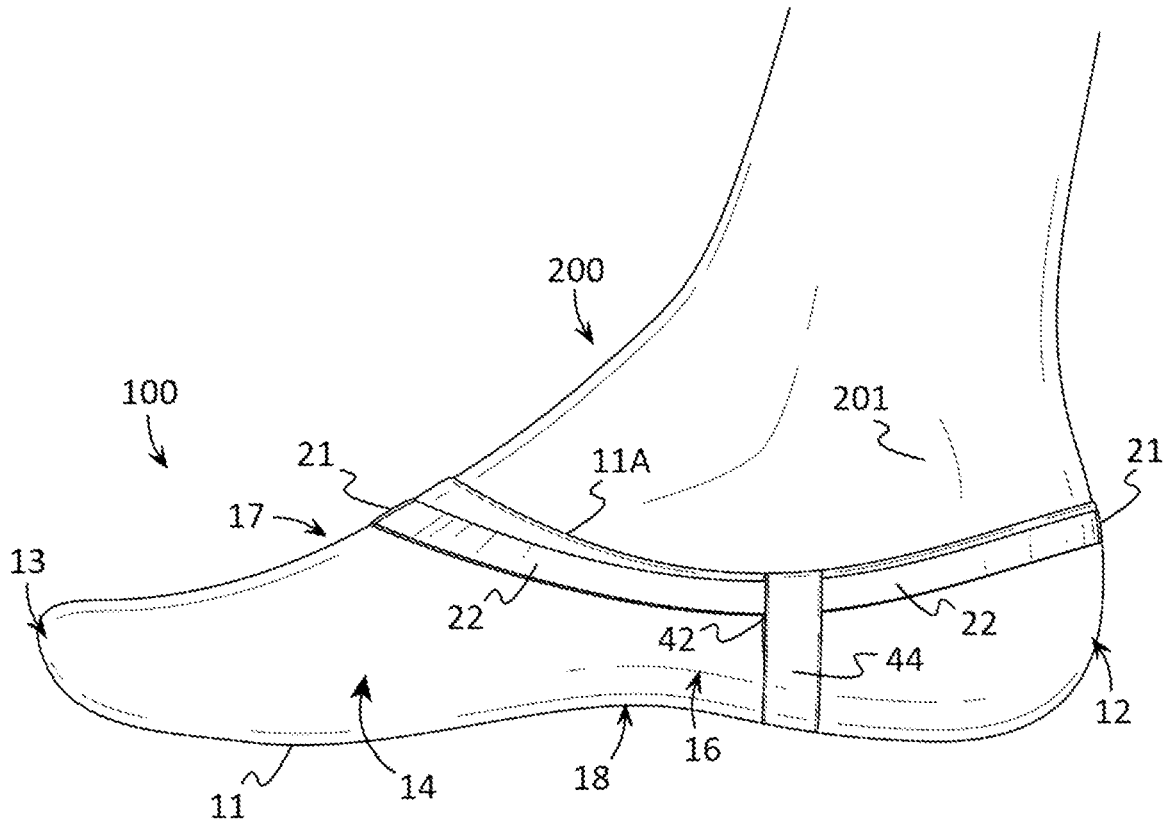
FIG. 4B-FIG. 4B shows a second side perspective view of yet another example of a low profile sock device according to various embodiments described herein.
Figure 5:
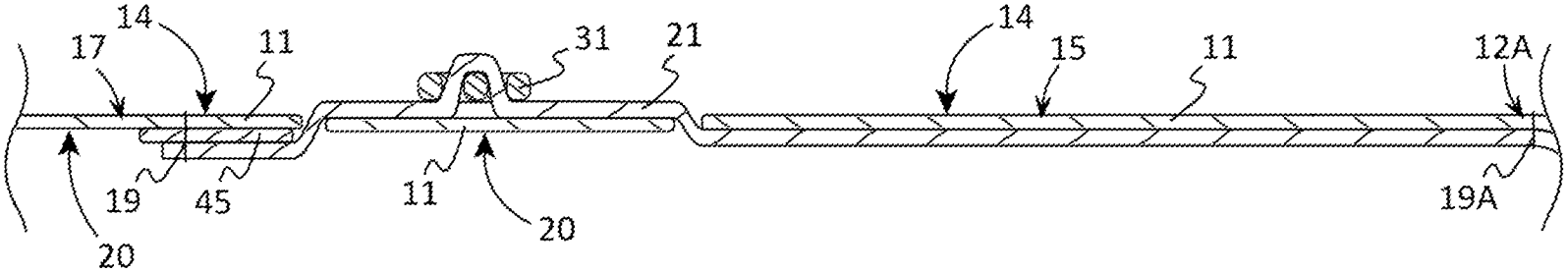
FIG. 5-FIG. 5 illustrates a partial, sectional, through line 5-5 shown in FIG. 1, elevation view of an example of a low profile sock device according to various embodiments described herein.

In some embodiments and as shown in FIGS. 4A and 4B, the device may comprise one or more buttresses, such as a first buttress 43 and a second buttress 44. A first side 15 may comprise a first buttress 43, and a second side 16 may comprise a second buttress 44. In some embodiments, a first buttress 43 and a second buttress 44 may be coupled together (for example, as being formed from a single length of material or by being sewn or otherwise coupled together) so that the first buttress 43 and/or the second buttress 44 may extend across the sole region 18. Optionally, a first aperture 41 of a first side 15 may be formed by a portion of a first buttress 43, and a second aperture 42 of a second side 16 may be formed by a portion of the second buttress 44. In some embodiments, a buttress 43, 44, may comprise a length of material coupled to a side 15, 16, which may comprise a loop or other opening which may function as an aperture 41, 42, through which portions of a retainer 21, 22, may be positioned so as to be movably coupled to the buttresses 43, 44, via the apertures 41, 42. In other embodiments, a buttress 43, 44, may comprise a length of material to which a retainer 21, 22, may be coupled in a stationary manner. Preferably, a buttress 43, 44, may comprise a flexible, and more preferably a resilient material, such as which may be used in the construction of a retainer 21, 22. A buttresses 43, 44, may be coupled to a portion of the body 11 via stitching or any other suitable coupling method.

Figure 3A:
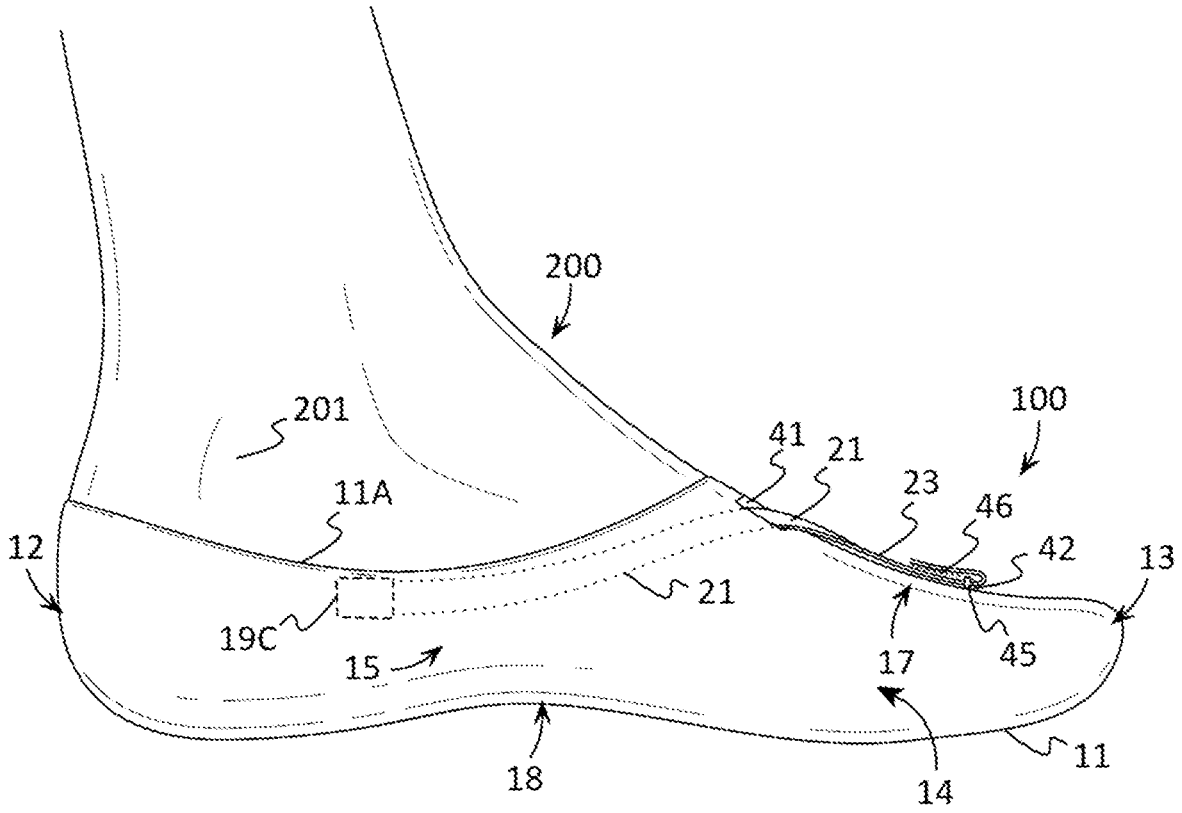
FIG. 3A-FIG. 3A shows a first side perspective view of still another example of a low profile sock device according to various embodiments described herein.
Figure 3B:
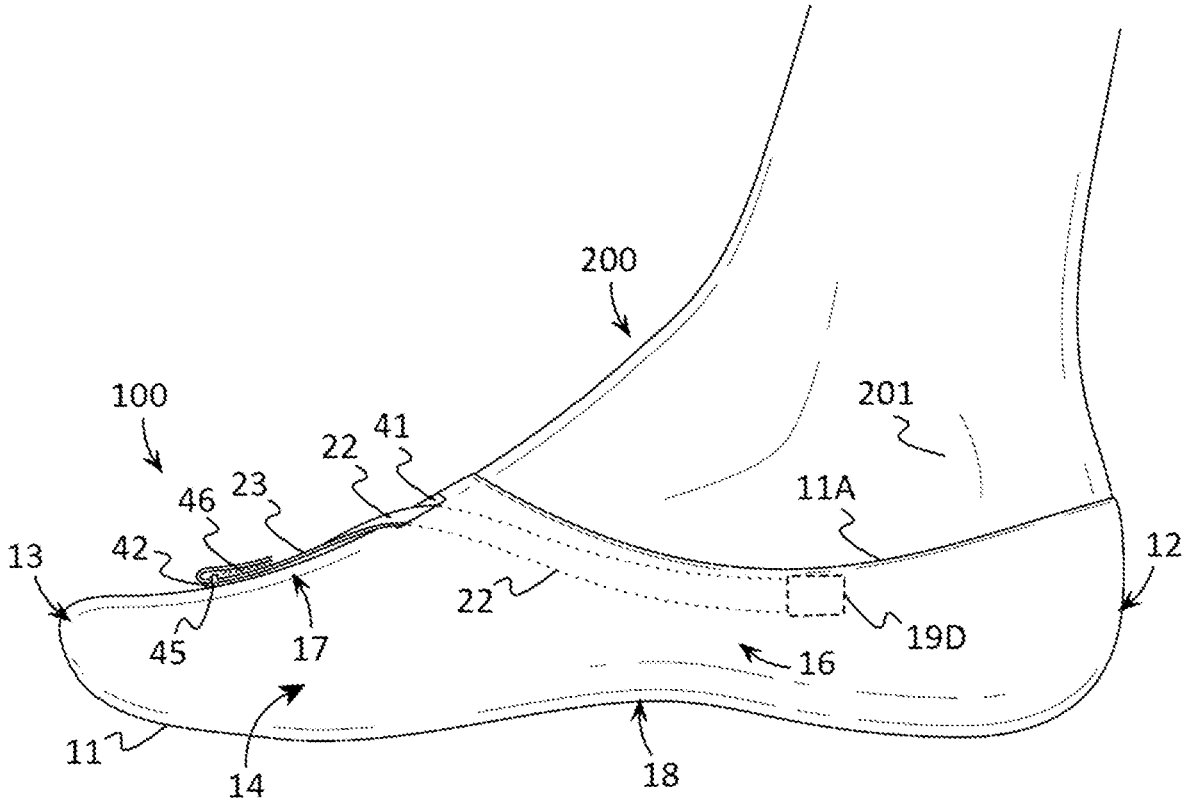
FIG. 3B-FIG. 3B illustrates a second side perspective view of still another example of a low profile sock device according to various embodiments described herein.

Referring now to FIGS. 3A and 3B, in some embodiments, the device 100 may comprise a body 11 for receiving portions of a foot 200 of a user. The body 11 may have a heel region 12, a toe region 13, an exterior surface 14, a first side 15, a second side 16, and an upper foot region 17. A unitary retainer 23 may be coupled to the upper foot region 17. A first retainer 21 may be coupled to the unitary retainer 23 and to the first side 15 (such as with stitching 19C coupling first retainer 21 to first side 15), and the first retainer 21 may be configured to tension the unitary retainer 23 (and therefore the upper foot region 17) and the first side 15 toward each other. A second retainer 22 may be coupled to the unitary retainer 23 and to the second side 16 (such as with stitching 19D coupling second retainer 23 to second side 16), and the second retainer 22 may be configured to tension the unitary retainer 23 (and therefore the upper foot region 17) and the second side 16 towards each other.

In some embodiments, a unitary retainer 23 may comprise a length of material to which a first 21 and second 22 retainer may each be coupled to and which may be coupled to a portion of the body 11, such as the upper foot region 17. Preferably, a unitary retainer 23 may comprise a flexible, and more preferably a resilient material, such as which may be used in the construction of a retainer 21, 22. A unitary retainer 23 may be coupled to a portion of the body 11 via stitching 19 or any other suitable coupling method. In preferred embodiments, a unitary retainer 23 may be formed by a portion of the first retainer 21 and a portion of the second retainer 22 so that the lengths of the portions of the retainers 21, 22, that are coupled together may form the length of the unitary retainer 23.

Also shown in FIGS. 3A and 3B, in some embodiments, the body 11 may comprise one or more apertures 41, 42, which may be coupled to or otherwise positioned on any portion of the body 11, such as an upper foot region 17. In further embodiments, the body 11 may comprise a first aperture 41 which preferably may be coupled to the upper foot region 17, and portions of the first retainer 21 and second retainer 22 may be movably received in the first aperture 41. In still further embodiments, the body 11 may comprise a second aperture 42 which preferably may be coupled to the upper foot region 17, and portions of the unitary retainer 23 may be movably received in the second aperture 42. Optionally, the second aperture 42 may be formed by all or portions of an upper reinforcement 45 of the upper foot region 17.

In some embodiments, a unitary retainer 23 may comprise a fastener 46 which may be configured to couple, and more preferably removably couple, two or more portions of the unitary retainer 23. In this manner, a fastener 46 may be configured to adjust the length of the unitary retainer 23 thereby adjusting the amount of tension tensioning the upper foot region 17 and sides 15, 16, together. In further embodiments, a fastener 46 may comprise a hook-and-loop fastener, a snap fastener, a clip fastener, a button and/or button hole, or any other type of fastener which may be used to removably couple different portions of a unitary retainer 23 to other portions of the unitary retainer 23 and/or to any other element of the device 100.

All or portions of a first 21 and/or second 22 retainer may be positioned above or below the exterior surface 14. In preferred embodiments, portions of the first retainer 21 that are between the first aperture 41 and the first side 15 may be positioned below the exterior surface 14 (as shown with the broken lines), and portions of the second retainer 22 that are between the first aperture 41 and the second side 16 may be positioned below the exterior surface 14 (as shown with the broken lines).

Turning to FIGS. 4A and 4B, in some embodiments, the device 100 may comprise a body 11 for receiving portions of a foot 200 of a user. The body 11 may have a heel region 12, a toe region 13, an exterior surface 14, a first side 15, a second side 16, and an upper foot region 17. A first retainer 21 may be coupled to the upper foot region 17 and to the heel region 12, and the first retainer 21 may be configured to tension the upper foot region 17 and the heel region 12 towards each other. A second retainer 22 may also be coupled to the upper foot region 17 and to the heel region 12, and the second retainer 22 may be configured to tension the upper foot region 17 and the heel region 12 towards each other. A first aperture 41 may be coupled to the first side 15, and portions of the first retainer 21 may be movably received in the first aperture 41. A second aperture 42 may be coupled to the second side 16, and portions of the second retainer 22 may be movably received in second first aperture 42.

In preferred embodiments, a first side 15 may comprise a first buttress 43, and a second side 16 may comprise a second buttress 44. The first aperture 41 of the first side 15 may be formed by a portion of a first buttress 43, and the second aperture 42 of the second side 16 may be formed by a portion of the second buttress 44. In some embodiments, a buttress 43, 44, may comprise a length of material coupled to a side 15, 16, which may comprise a loop or other opening which may function as an aperture 41, 42, through which portions of a retainer 21, 22, may be positioned so as to be optionally movably coupled to the buttresses 43, 44, (and therefore movably coupled to the sides 15, 16) via the apertures 41, 42.

Generally, a first retainer 21 may contact and/or be coupled to portions of the first side 15, and a second retainer 22 may contact and/or be coupled to portions of the second side 16. In some embodiments, a portion of the first retainer 21 that may be coupled to the heel region 12 may also be coupled to a portion of the second retainer 22 that may also be coupled to the heel region 12. In further embodiments, a portion of the first retainer 21 that may be coupled to the upper foot region 17 may also be coupled to a portion of the second retainer 22 that may also be coupled to the upper foot region 17. In further embodiments, one end of a first retainer 21 may be coupled to one end of a second retainer 22. In further embodiments, both ends of a first retainer 21 and second retainer 22 may be coupled together as a closed loop shape as perhaps best shown in FIGS. 4A and 4B.

While some exemplary shapes and sizes have been provided for elements of the device 100, it should be understood to one of ordinary skill in the art that the body 11, retainers 21, 22, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A low profile sock device, the device comprising:

a body for receiving portions of a foot of a user, the body having a heel region, a toe region, an exterior surface, a first side, a second side, a body perimeter, a sole region, and an upper foot region;

a first retainer having a first front end and a first back end, wherein the first retainer extends above the exterior surface of the body at the upper foot region, wherein the first front end is coupled to the upper foot region between the toe region and the body perimeter, wherein the first back end is coupled to the heel region between the sole region and the body perimeter, and wherein the first retainer is configured to tension the upper foot region and the heel region towards each other; and a second retainer having a second front end and a second back end, wherein the second front end is coupled to the upper foot region between the toe region and the body perimeter, wherein the second back end is coupled to the heel region between the sole region and the body perimeter, and wherein the second retainer is configured to tension the upper foot region and the heel region towards each other.

2. The device of claim 1, wherein the first side comprises a first aperture, wherein portions of the first retainer are movably received in the first aperture, wherein the second side comprises a second aperture, and wherein portions of the second retainer are movably received in the second aperture.

3. The device of claim 2, wherein the first aperture is formed in the body, and wherein the second aperture is formed in the body.

4. The device of claim 2, wherein portions of the first retainer that are between the first aperture and the heel region are positioned below the exterior surface, wherein portions of the first retainer that are between the first aperture and the upper foot region are positioned above the exterior surface, wherein portions of the second retainer that are between the second aperture and the heel region are positioned below the exterior surface, and wherein portions of the second retainer that are between the second aperture and the upper foot region are positioned above the exterior surface.

5. The device of claim 1, wherein the first retainer and second retainer are made of a resilient material.

6. The device of claim 1, further comprising a tensioner coupled of one of the first retainer and the second retainer.

7. The device of claim 1, further comprising an upper reinforcement coupled to the upper foot region, wherein the first retainer and second retainer are each coupled to the upper reinforcement.

8. The device of claim 1, wherein the first front end is coupled to the upper foot region proximate to the first side, wherein the first back end is coupled to the heel region proximate to the first side, wherein the second front end is coupled to the upper foot region proximate to the second side, and wherein the second back end is coupled to the heel region proximate to the second side.

9. The device of claim 1, wherein the first front end is coupled to the upper foot region proximate to the second side, wherein the first back end is coupled to the heel region proximate to the first side, wherein the second front end is coupled to the upper foot region proximate to the first side, and wherein the second back end is coupled to the heel region proximate to the second side.

* * * * *